US006415937B1

(12) United States Patent
DeJong et al.

(10) Patent No.: US 6,415,937 B1
(45) Date of Patent: Jul. 9, 2002

(54) BOTTLE ADAPTER

(76) Inventors: Lorraine DeJong; Jared DeJong, both of 13811 Yakima Valley Hwy., Zillah, WA (US) 98953

( * ) Notice: Subject to any disclaimer, the term of this patent is extended or adjusted under 35 U.S.C. 154(b) by 0 days.

(21) Appl. No.: 09/561,384

(22) Filed: Apr. 27, 2000

(51) Int. Cl.[7] ..... B65D 23/12
(52) U.S. Cl. ..... 215/386; 215/11.1
(58) Field of Search ..... 215/386, 11.1, 215/11.6, 43, 44, 45, DIG. 8; 220/4.26, 4.27, 4.03, 287; 141/364, 319, 384, 346, 332; 206/828; 285/333, 138, 148.19, 148.32

(56) References Cited

U.S. PATENT DOCUMENTS

| | | | | | |
|---|---|---|---|---|---|
| 3,217,917 | A | * | 11/1965 | George | 215/100 |
| 3,232,503 | A | * | 2/1966 | Barton | 215/11.3 |
| 4,173,989 | A | * | 11/1979 | Prest | 138/109 |
| 4,238,040 | A | | 12/1980 | Fitzpatrick | 215/11 |
| 4,266,813 | A | * | 5/1981 | Oliver | 285/12 |
| 4,703,863 | A | | 11/1987 | Kohus | 215/11.1 |
| 4,778,068 | A | | 10/1988 | Kohus | 215/11.1 |
| 5,024,341 | A | * | 6/1991 | Dekerle | 215/11.1 |
| 5,145,077 | A | | 9/1992 | Rohrig | 215/11.1 |
| 5,150,800 | A | | 9/1992 | Sarter et al. | 215/11.4 |
| 5,316,160 | A | | 5/1994 | Cautereels | 215/11.1 |
| 5,422,129 | A | | 6/1995 | Draddy | 426/115 |
| 5,472,025 | A | * | 12/1995 | Conrad et al. | 141/332 |
| 5,551,583 | A | | 9/1996 | Sachathamakul et al. | 215/386 |
| 5,573,507 | A | | 11/1996 | Moser et al. | 604/77 |
| 5,588,548 | A | * | 12/1996 | Brankley | 215/388 |
| 5,688,238 | A | | 11/1997 | Moser et al. | 604/77 |
| 5,791,503 | A | * | 8/1998 | Lyons | 215/11.5 |
| D414,873 | S | | 10/1999 | Kwiecinski | D24/197 |
| 6,089,389 | A | * | 7/2000 | Sharon et al. | 215/11.1 |
| 6,092,681 | A | * | 7/2000 | Shaw et al. | 215/11.6 |

* cited by examiner

*Primary Examiner*—Lee Young
*Assistant Examiner*—Lien Ngo
(74) *Attorney, Agent, or Firm*—Stratton Ballew PLLC

(57) ABSTRACT

The invention provides a bottle adapter for securing an attachment to a bottle. The attachment can be a nipple and ring assembly for a baby bottle. The bottle adapter has a base, and the base has a bottom end and a top end. A bottle receiving portion extends from the bottom end of the base, and an attachment receiving portion extends from the top end of the base. The bottle receiving portion includes an outer bottle receiving ring and an inner bottle receiving ring. The attachment receiving portion includes an outer attachment receiving ring and an inner attachment receiving ring. The base of the bottle adapter also includes a passage defined therein for allowing the flow of a fluid from the bottle receiving portion to the attachment receiving portion of the bottle adapter. In an embodiment of the invention, the bottle adapter is sized to adapt both a disposable liner bottle and a traditional bottle to receive both a disposable liner bottle nipple and ring assembly and a traditional nipple and ring assembly.

10 Claims, 5 Drawing Sheets

DeJong
09/561,384

BOTTLE ADAPTER

TECHNICAL FIELD

The invention relates to the field of bottles and attachments therefor. More specifically, the invention relates to a device for interchangeably securing nipple assemblies and the like to baby feeding bottles.

BACKGROUND OF THE INVENTION

Various styles of infant feeding bottles are known. One typical feeding bottle design, referred to herein as the traditional bottle, is generally cylindrical in shape, and has a relatively narrow, externally threaded mouth. A nipple positioned over the mouth of the bottle is held in place by an internally threaded ring secured to the externally threaded mouth. The nipple and threaded ring assembly form a seal at the mouth of the bottle, to prevent liquid from leaking out of the bottle. Traditional baby bottles generally have a standard-sized mouth, so that nipples and rings of varying brands can be interchanged.

Another well known feeding bottle design is adapted to receive a disposable liner. This bottle design is referred to herein as the disposable liner bottle. This design includes a cylindrical bottle having a relatively wide, externally threaded mouth. A nipple positioned over the disposable liner and the mouth of the bottle is held in place by an internally threaded ring secured to the externally threaded mouth. The nipple and threaded ring assembly secure the disposable liner in place, and form a seal to prevent liquid from leaking out of the disposable liner.

In some cases, it is found that an infant prefers the shape of one nipple over another. In other cases, it may be discovered that an infant or care giver is more comfortable holding a specific bottle style. In yet other situations, it may be necessary to feed a newborn from a disposable liner bottle. Thus, it may be most preferable to feed an infant from a bottle of a selected style, with a nipple of selected shape.

A problem often exists, however, in accommodating these preferences. The nipple and threaded ring assembly of a traditional bottle is not interchangeable with the nipple and threaded ring assembly of a disposable liner bottle. Therefore, if it is necessary to feed an infant from a disposable liner bottle, the selection of nipples available to use is limited to those specifically designed for the disposable liner bottle. Likewise, if only traditional bottles are available, only nipple and threaded ring assemblies for traditional bottles can be used, even if the infant prefers or requires a different nipple shape.

The non-interchangeability of nipple and threaded ring assemblies between bottle styles is also problematic from a practical standpoint. For example, it may be initially necessary to feed a very young infant from a wide mouth bottle which accommodates disposable liners. As the infant grows, however, the features of the disposable liners may no longer be required. It may at this point be desirable, for reasons of cost and convenience, to switch to a traditional narrow mouthed bottle that does not require the use of disposable liners. But, if the infant has become accustomed to the nipple shape unique to the wide mouth bottle, it can be difficult or even impossible to train the infant to accept a new nipple shape.

SUMMARY OF INVENTION

The invention provides a bottle adapter for securing an attachment to a bottle. The attachment can be a nipple and ring assembly for a baby bottle. The bottle adapter has a base, and the base has a bottom end and a top end. A bottle receiving portion extends from the bottom end of the base, and an attachment receiving portion extends from the top end of the base.

In an embodiment, the bottle receiving portion includes an outer bottle receiving ring and an inner bottle receiving ring. The outer bottle receiving ring and the inner bottle receiving ring are substantially concentric. In an additional embodiment of the invention, the bottle receiving portion includes a single bottle receiving ring.

In an embodiment, the attachment receiving portion includes an outer attachment receiving ring and an inner attachment receiving ring. The outer attachment receiving ring and the inner attachment receiving ring are substantially concentric. In an additioanl embodiment of the invention, the attachment receiving portion includes a single attachment receiving ring.

The base of the bottle adapter includes a passage defined therethrough for allowing the flow of a fluid from the bottle receiving portion to the attachment receiving portion of the bottle adapter. In an embodiment, the passage in the base is substantially concentric with the inner bottle receiving ring and the inner attachment receiving ring.

In an embodiment of the invention, the bottle adapter is sized to adapt a disposable liner bottle to receive a traditional nipple and ring assembly, and is also sized to adapt a traditional bottle to receive a disposable liner bottle nipple and ring assembly.

An advantage of the bottle adapter of the present invention is that it allows the interchangeable use of nipple and ring assemblies, or other attachments, on bottles such as baby bottles.

Another advantage of the bottle adapter of the present invention is that it allows the use of a traditional nipple and ring assembly with a disposable liner baby bottle.

A further advantage of the bottle adapter of the present invention is that it allows the use of a disposable liner bottle nipple and ring assembly with a traditional baby bottle.

Yet an additional advantage of the bottle adapter of the present invention is that with the bottle adapter, the various needs and preferences of infants and care providers with respect to the type of bottle and nipple and ring assembly can be used, can be accommodated. The bottle adapter makes it possible to continue using the nipple and ring assembly of a disposable liner bottle without continuing to use the disposable liner bottle itself. Similarly, the bottle adapter makes it possible to use a traditional bottle nipple and ring assembly with a disposable liner bottle, which may be necessary to accommodate the preference of the infant.

These and other features and advantages of the invention will be made clear in the description and drawings that follow.

DETAILED DESCRIPTION OF SPECIFIC EMBODIMENTS

FIGS. 1, 2, and 7–10 of the drawings show baby bottles which can be used with the present invention. The bottles are depicted and described herein in order to better explain the invention. It will be understood that the bottles shown are representative only, and that bottles of other configurations, sizes, and styles can also be used in conjunction with the invention.

Figure 1:
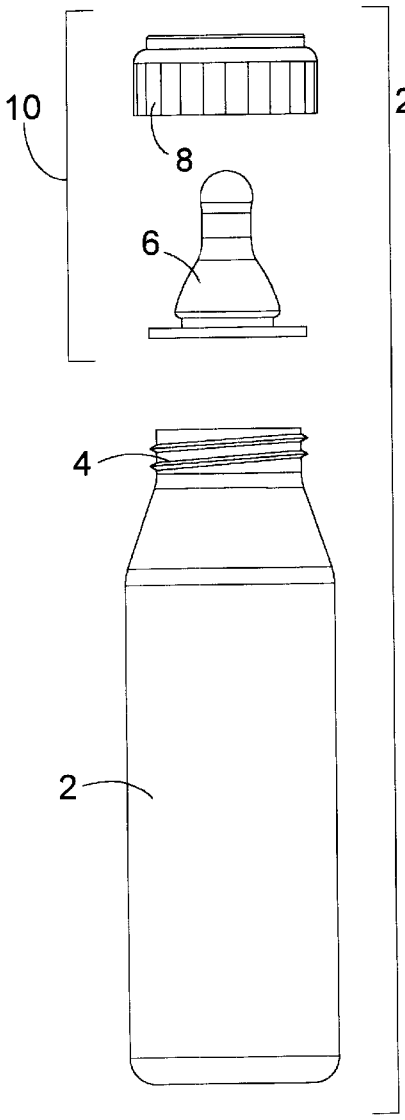
Fig. 1 (Prior Art)
FIG. 1 is an exploded side view of a traditional baby bottle.

A traditional bottle 2 is shown in detail in FIG. 1. The traditional bottle has a relatively narrow, male threaded mouth 4. A traditional nipple 6 and traditional ring 8 form a traditional nipple and ring assembly 10, which is threadable onto the narrow threaded mouth of the traditional bottle.

Figure 2:
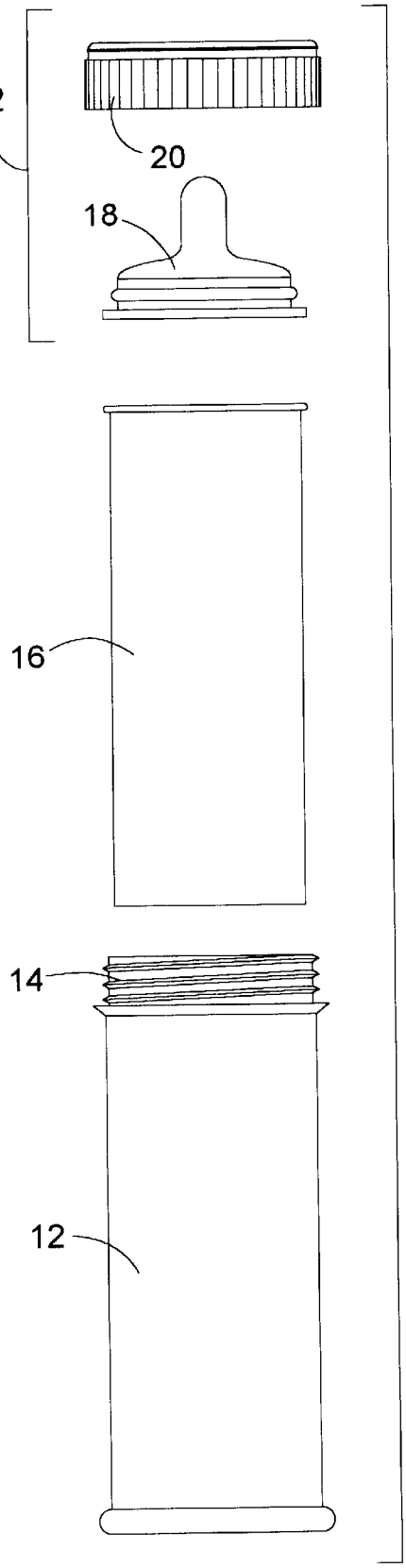
Fig. 2 (Prior Art)
FIG. 2 is an exploded side view of a disposable liner baby bottle.

A disposable liner bottle 12 is shown in detail in FIG. 2. The disposable liner bottle has a relatively wide, male threaded mouth 14. This bottle is adapted to receive a disposable liner 16. A disposable liner bottle nipple 18 and a disposable liner bottle ring 20 form a disposable liner bottle nipple and ring assembly 22, which is threadable onto the wide threaded mouth of the disposable liner bottle.

The baby bottles depicted in the drawings are representative of baby bottles typically available for purchase by a consumer. The traditional bottle nipple and ring assembly 10 will not fit properly on the disposable liner bottle 12; likewise, the disposable liner bottle ring and nipple assembly 22 will not fit properly on the traditional bottle 2.

The bottle adapter 24 of the present invention is shown in FIGS. 3 through 10 of the accompanying drawings. The bottle adapter includes a base 26, a bottle receiving portion 28 and an attachment receiving portion 30. The base has a bottom end 32 and a top end 34. The bottle receiving portion extends from the bottom end of the base, and the attachment receiving portion extends from the top end of the base. In a preferred embodiment, the base, the bottle receiving portion and the attachment receiving portion of the bottle adapter form a single contiguous unit. Most preferably, the bottle adapter consists of a single piece of injection molded plastic or other suitable material.

The bottle receiving portion 28 of the bottle adapter 24 is attachable to a bottle. In the preferred embodiment described herein, the bottle is a feeding bottle, such as the traditional bottle 2 shown in FIGS. 1, 8 and 10, or the disposable liner bottle 12 shown in FIGS. 2, 7 and 9.

Figure 4:
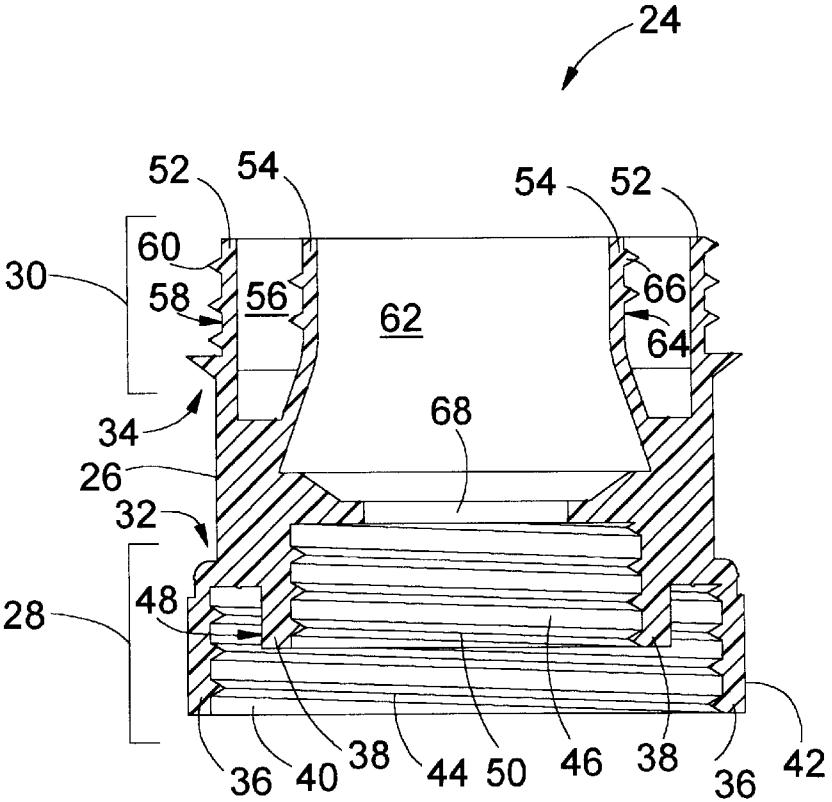
FIG. 4 is a section view of a preferred embodiment of the bottle adapter of the present invention, taken along line 4—4 of FIG. 3.
Figure 3:
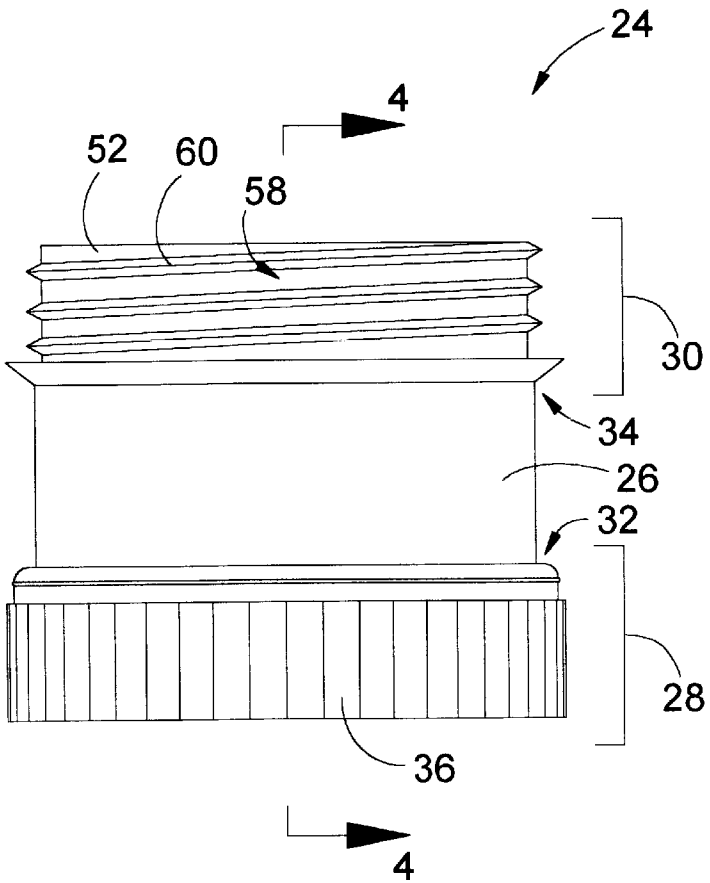
FIG. 3 is a side view of a preferred embodiment of the bottle adapter of the present invention.
Figure 6:
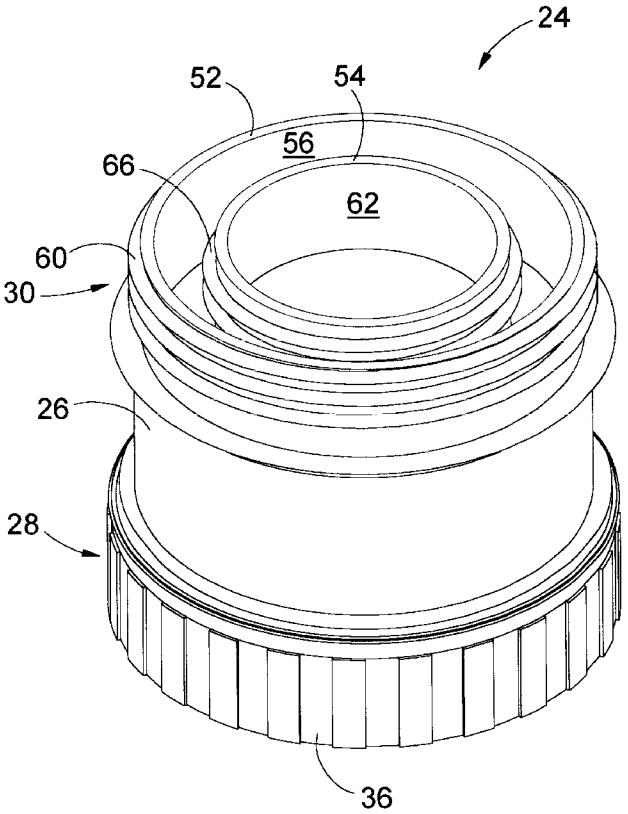
FIG. 6 is a perspective view of a preferred embodiment of the bottle adapter of the present invention.
Figure 5:
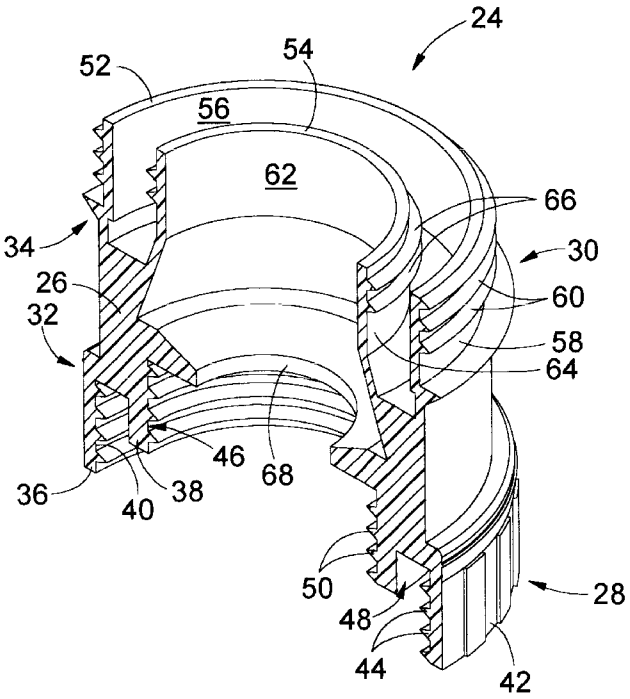
FIG. 5 is a section perspective view of a preferred embodiment of the bottle adapter of the present invention.

The bottle receiving portion 28 of the bottle adapter 24 is detailed in FIGS. 4 and 5. The bottle receiving portion preferably includes an outer bottle receiving ring 36 and an inner bottle receiving ring 38. The outer bottle receiving ring extends from the bottom end 32 of the base 26, and has an interior surface 40 and an exterior surface 42. Preferably, the interior surface of the outer bottle receiving ring further includes outer bottle receiving ring threads 44. The outer bottle receiving ring is sized to receive the mouth of a bottle, such as the male threaded mouth 14 of the disposable liner bottle 12 shown in FIG. 2. Alternatively, the outer bottle receiving ring may be sized to receive any bottle or container which requires adaptation.

The inner bottle receiving ring 38 is smaller in diameter than the outer bottle receiving ring 36, and is preferably concentric with the outer bottle receiving ring. The inner bottle receiving ring extends from the bottom end 32 of the base 26, and has an interior surface 46 and an exterior surface 48. Preferably, the interior surface of the inner bottle receiving ring further includes second bottle receiving threads 50. The inner bottle receiving ring is sized to receive the mouth of a bottle, such as the male threaded mouth 4 of the traditional bottle 2 shown in FIG. 1. Alternatively, the inner bottle receiving ring may be sized to receive any bottle or container which requires adaptation, providing the diameter of the inner bottle receiving ring is less than the diameter of the outer bottle receiving ring.

In an additional embodiment of the invention, the bottle receiving portion 28 of the bottle adapter 24 includes a single bottle receiving ring, such as the outer bottle receiving ring 36 or the inner bottle receiving ring 38

The attachment receiving portion 30 of the bottle adapter 24 is configured to receive an attachment. In a preferred embodiment, the attachment is a ring and nipple assembly, such as the traditional ring and nipple assembly 10 shown in FIG. 1, or the disposable liner bottle ring and nipple assembly 22 shown in FIG. 2. Other types of attachments are also contemplated.

The attachment receiving portion of the bottle adapter is detailed in FIGS. 3, 4, 5 and 6. The attachment receiving portion preferably includes an outer attachment receiving ring 52 and an inner attachment receiving ring 54. The outer attachment receiving ring has an interior surface 56 and an exterior surface 58. Preferably, the exterior surface of the outer attachment receiving ring further includes outer attachment receiving ring threads 60. The outer attachment receiving ring is sized to receive an attachment, such as the disposable liner bottle nipple and ring assembly 22 shown in FIG. 2. Alternatively, the outer attachment receiving ring may be sized to receive any attachment that would be used in conjunction with a bottle.

The inner attachment receiving ring 54 is smaller in diameter than the outer attachment receiving ring 52, and is preferably concentric with the outer attachment receiving ring. The inner attachment receiving ring has an interior surface 62 and an exterior surface 64. Preferably, the exterior surface of the inner attachment receiving ring further includes inner attachment receiving ring threads 66. The inner attachment receiving ring is sized to receive an attachment such as the traditional nipple and ring assembly 10 shown in FIG. 1. Alternatively, the inner attachment receiving ring may be sized to receive any attachment which would be used in conjunction with a bottle, providing the diameter of the inner attachment receiving ring is less than the diameter of the outer attachment receiving ring.

In an additional embodiment of the invention, the attachment receiving portion 30 of the bottle adapter 24 includes a single attachment receiving ring, such as the outer attachment receiving ring 52 or the inner attachment receiving ring 54.

The base 26 of the bottle adapter 24 further includes an opening 68 defined in the base. The opening permits the passage of liquid between the bottle and the ring and nipple assembly to which the adapter is attached. Preferably, the opening is cylindrical, and is substantially concentric within the inner bottle receiving ring 38 and the inner attachment receiving ring 54.

The bottle adapter 24 of the present invention is used to adapt an attachment to a bottle. Preferably, the bottle adapter is used to adapt a baby bottle to receive a nipple and ring assembly of a different style, which would not otherwise fit on the chosen baby bottle.

In an embodiment, the bottle adapter 24 is sized to adapt a traditional bottle 2 to a disposable liner bottle nipple and ring assembly 22, and also to adapt a disposable liner bottle 12 to a traditional nipple and ring assembly 10. This embodiment allows two-way interchangeable use of bottle styles and nipple and ring assembly styles.

In an additional embodiment of the invention, the bottle receiving portion 28 of the bottle adapter 24 includes only the outer bottle receiving ring 36, and the attachment receiving portion 30 of the bottle adapter includes both the outer attachment receiving ring 52 and the inner attachment receiving ring 54. In this embodiment, the bottle adapter is configured to attach to a disposable liner bottle 12, and to receive both the traditional nipple and ring assembly 10 and the disposable liner bottle nipple and ring assembly 22.

Alternatively, the bottle receiving portion 28 of the bottle adapter 24 includes both the outer bottle receiving ring 36 and the inner bottle receiving ring 38, and the attachment receiving portion 30 includes only the inner attachment receiving ring 54. In this embodiment, the bottle adapter is configured to attach to either a traditional bottle 2 or a disposable liner bottle 12, and to receive only the traditional nipple and ring assembly 10.

Also alternatively, the bottle receiving portion 28 of the bottle adapter 24 includes only the inner bottle receiving ring 38, and the attachment receiving portion 30 of the bottle adapter includes both the outer attachment receiving ring 52 and the inner attachment receiving ring 54. In this embodiment, the bottle adapter is configured to attach to a traditional bottle 2, and to receive either the traditional nipple and ring assembly 10 or the disposable liner bottle nipple and ring assembly 22.

In an additional embodiment, the bottle receiving portion 28 of the bottle adapter 24 includes both the outer bottle receiving ring 36 and the inner bottle receiving ring 38, and the attachment receiving portion 30 includes only the outer attachment receiving ring 52. In this embodiment, the bottle adapter is configured to attach to either a traditional bottle 2 or a disposable liner bottle 12, and to receive only the disposable liner bottle nipple and ring assembly 22.

Figure 8:
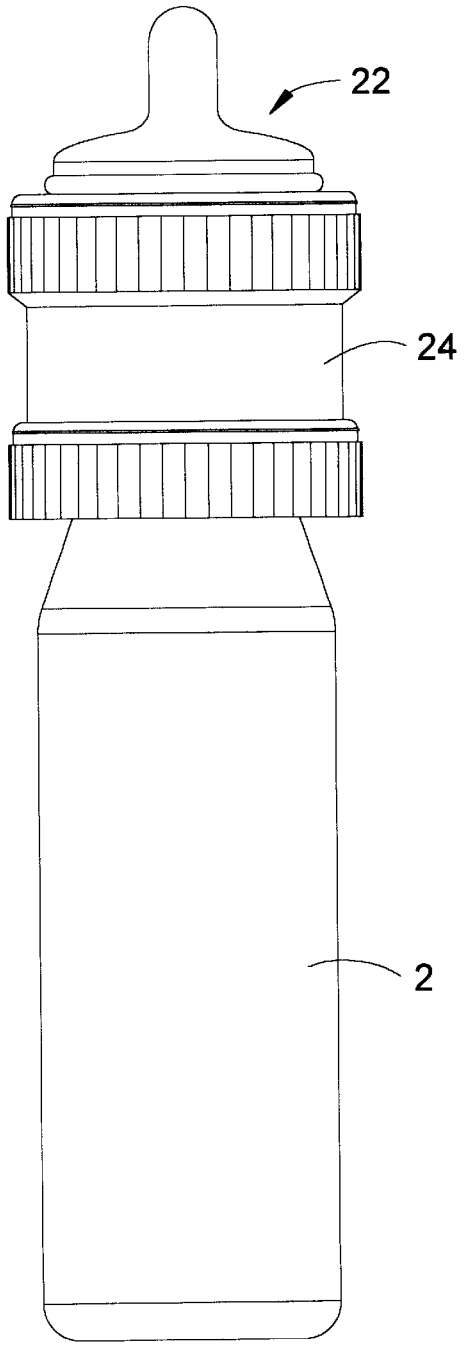
FIG. 8 is a side view of a preferred embodiment of the bottle adapter of the present invention in use.
Figure 10:
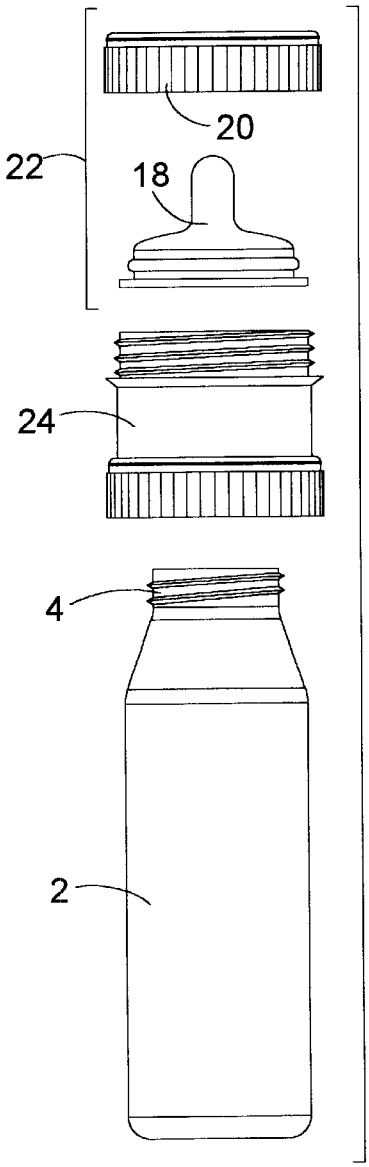
FIG. 10 is an exploded side view of a preferred embodiment of the bottle adapter of the present invention in use.

FIGS. 8 and 10 show an embodiment of the bottle adapter 24 in use adapting a traditional bottle 2 to receive a disposable liner bottle nipple and ring assembly 22. In this embodiment, the inner bottle receiving ring 38, as best seen in FIGS. 4 and 5, is sized to receive the male threaded mouth 4 of the traditional bottle, and the outer attachment receiving ring 52 is sized to receive the disposable liner bottle nipple and ring assembly. To use the bottle adapter, a user first fills the traditional bottle with a liquid. The bottle adapter is then attached to the traditional bottle by threading the inner bottle receiving ring onto the male threaded mouth of the traditional bottle. Finally, the disposable liner bottle nipple and ring assembly is threaded onto the outer attachment receiving ring of the bottle adapter.

Figure 7:
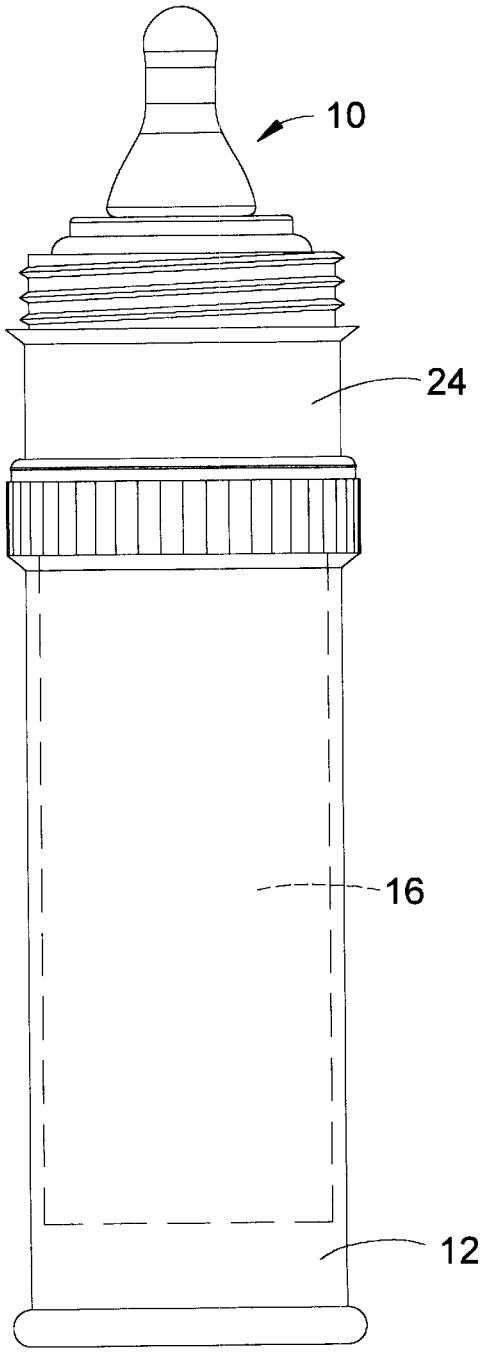
FIG. 7 is a side view of a preferred embodiment of the bottle adapter of the present invention in use.
Figure 9:
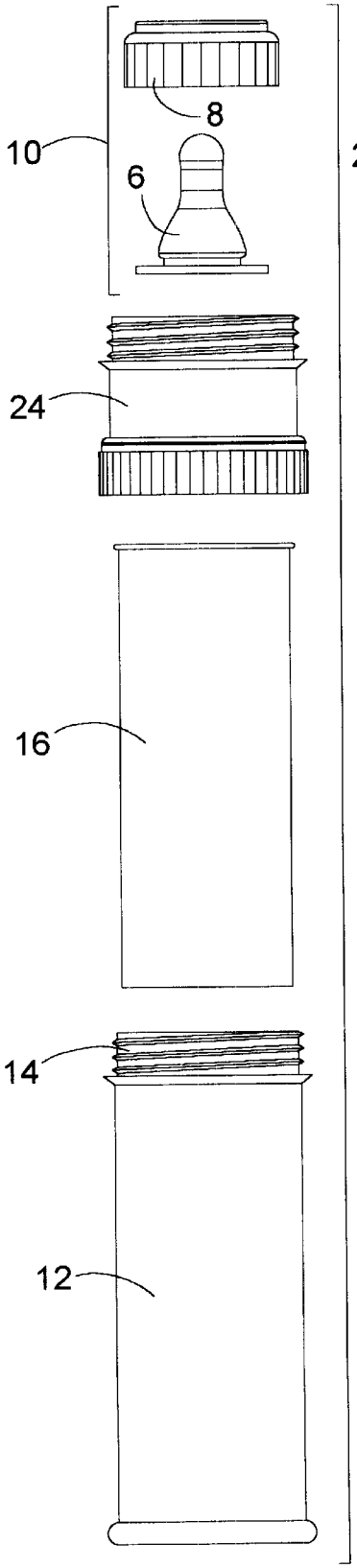
FIG. 9 is an exploded side view of a preferred embodiment of the bottle adapter of the present invention in use.

In an additional preferred embodiment of the invention, the bottle adapter 24 is used to adapt a disposable liner bottle 12 to receive a traditional nipple and ring assembly 10, as shown in FIGS. 7 and 9. In this embodiment, the outer bottle receiving ring 36, best seen in FIGS. 4 and 5, is sized to receive the male threaded mouth 14 of the disposable liner bottle, and the inner attachment receiving ring 54 is sized to receive the traditional nipple and ring assembly. To use the bottle adapter in this embodiment, a disposable liner 16 is installed in the disposable liner bottle. The disposable liner is then filled with a liquid, and the outer bottle receiving ring of the bottle adapter is threaded onto the male threaded mouth of the disposable liner bottle. Finally, the traditional bottle nipple and ring assembly is threaded onto the inner attachment receiving ring 54.

In compliance with the statutes, the invention has been described in language more or less specific as to structural features and process steps. While this invention can be embodied in different forms, the specification describes and illustrates preferred embodiments of the invention. It will be understood that this disclosure is an exemplification of the principles of the invention, and is not intended to limit the invention to the particular embodiments described. Those with ordinary skill in the art will appreciate that other embodiments and variations of the invention, which employ the same inventive concepts as the invention, are possible. Therefore, the invention is not to be limited except by the following claims, as appropriately interpreted in accordance with the doctrine of equivalents.

What is claimed is:

1. A bottle adapter for securing an attachment to a bottle, the bottle adapter comprising:

a base, the base having a bottom end and a top end;

a bottle receiving portion extending from the bottom end of the base, the bottle receiving portion including an outer bottle receiving ring and an inner bottle receiving ring;

an attachment receiving portion extending from the top end of the base, the attachment receiving portion including:

an outer attachment receiving ring;

an inner attachment receiving ring, the inner attachment receiving ring having an outer surface, and the outer surface including inner attachment receiving ring threads;

the outer attachment receiving ring and the inner attachment receiving ring being substantially concentric; and a passage defined in the base for allowing the flow of a fluid from the bottle receiving portion to the attachment receiving portion of the bottle adapter.

2. The bottle adapter of claim 1, wherein the outer bottle receiving ring is sized to receive a disposable liner bottle.

3. The bottle adapter of claim 1, wherein the outer bottle receiving ring includes an inner surface, and the inner surface includes outer bottle receiving ring threads.

4. The bottle adapter of claim 1, wherein the inner bottle receiving ring is sized to receive a traditional bottle.

5. The bottle adapter of claim 1, wherein the inner bottle receiving ring includes an inner surface, and the inner surface includes inner bottle receiving ring threads.

6. The bottle adapter of claim 1, wherein the outer attachment receiving ring is sized to receive a disposable liner bottle nipple and ring assembly.

7. The bottle adapter of claim 1, wherein the outer attachment receiving ring includes an outer surface, and the outer surface includes outer attachment receiving ring threads.

8. The bottle adapter of claim 1, wherein the inner attachment receiving ring is sized to receive a traditional nipple and ring assembly.

9. The bottle adapter of claim 1, wherein the outer bottle receiving ring, the inner bottle receiving ring, the outer attachment receiving ring, the inner attachment receiving ring, and the passage defined in the base are substantially concentric.

10. A bottle adapter for securing an attachment to a bottle, the bottle adapter comprising:

a base, the base having a bottom end and a top end;

a bottle receiving portion extending from the bottom end of the base, the bottle receiving portion including an outer bottle receiving ring, the outer bottle receiving ring sized to receive a disposable liner bottle, and an inner bottle receiving ring, the inner bottle receiving ring sized to receive a traditional bottle, the outer bottle receiving ring and the inner bottle receiving ring being substantially concentric;

an attachment receiving portion extending from the top end of the base, the attachment receiving portion including an outer attachment receiving ring, the outer attachment receiving ring sized to receive a disposable liner bottle nipple and ring assembly, and an inner attachment receiving ring, the-inner attachment ring including a threaded outer surface, and the inner attachment receiving ring sized to receive a traditional nipple and ring assembly, the outer attachment receiving ring and the inner attachment receiving ring being substantially concentric; and a passage defined in the base for allowing the flow of a fluid from the bottle receiving portion to the attachment receiving portion of the bottle adapter, the passage being substantially concentric with the inner bottle receiving ring and the inner attachment receiving ring.

* * * * *